United States Patent [19]

Edge et al.

[11] Patent Number: 4,537,709

[45] Date of Patent: Aug. 27, 1985

[54] LIQUID DETERGENT COMPOSITION COMPRISING SELECTED ALKYLBENZENE SULPHONATES AND ALKYL ETHER SULPHATES

[75] Inventors: David J. Edge, Chester; Appaya R. Naik, Merseyside; Melvin Scott, Cheshire, all of England

[73] Assignee: Lever Brothers Company, New York, N.Y.

[21] Appl. No.: 551,456

[22] Filed: Nov. 14, 1983

[30] Foreign Application Priority Data

Nov. 16, 1982 [GB] United Kingdom ..... 8232644

[51] Int. Cl.[3] ..... C11D 1/12; C11D 1/29; C11D 1/37; C11D 3/065

[52] U.S. Cl. ..... 252/558; 252/534; 252/553

[58] Field of Search ..... 252/553, 534, 558

[56] References Cited

U.S. PATENT DOCUMENTS

| | | | |
|---|---|---|---|
| Re. 27,096 | 3/1971 | Walker | 252/553 X |
| 4,018,720 | 4/1977 | Lengyel et al. | 252/534 |
| 4,061,603 | 12/1977 | Rubinfeld | 252/534 X |
| 4,235,752 | 11/1980 | Rossall et al. | 252/553 X |
| 4,435,317 | 3/1984 | Gerritsen et al. | 252/553 X |

FOREIGN PATENT DOCUMENTS

| | | |
|---|---|---|
| 70077 | 1/1983 | European Pat. Off. . |
| 1068528 | 5/1967 | United Kingdom . |
| 1164854 | 9/1969 | United Kingdom . |
| 1324370 | 7/1973 | United Kingdom . |
| 1349554 | 4/1974 | United Kingdom . |
| 1360242 | 7/1974 | United Kingdom . |
| 1542696 | 3/1979 | United Kingdom . |
| 2010893 | 7/1979 | United Kingdom . |
| 2114996 | 9/1983 | United Kingdom . |

*Primary Examiner*—John E. Kittle
*Assistant Examiner*—Mukund J. Shah
*Attorney, Agent, or Firm*—Milton L. Honig; James J. Farrell

[57] ABSTRACT

In light-duty liquid detergent compositions suitable for hand dishwashing, improved foaming performance, especially in hard water, is obtained by using combinations of particular alkylbenzene sulphonates (linear $C_{10}$–$C_{13}$ alkylbenzene sulphonates substantially free of other alkyl chain lengths and containing only minor amounts of $C_{13}$ material) and particular alkyl ether sulphates (those containing 20% or less of $C_{14}$ and above material and having an average degree of ethoxylation of from 1 to 12).

14 Claims, No Drawings

LIQUID DETERGENT COMPOSITION COMPRISING SELECTED ALKYLBENZENE SULPHONATES AND ALKYL ETHER SULPHATES

The present invention relates to high-foaming liquid detergent compositions suitable for use in fabric washing, shampoos, and above all, in manual dishwashing operations in both hard and soft water.

The term "dishes" as used herein means any utensils involved in food preparation or consumption which may be required to be washed to free them from food particles and other food residues, greases, proteins, starches, gums, dyes, oils and burnt organic residues.

Light-duty liquid detergent compositions such as are suitable for use in washing dishes are well-known. Many of the formulations in commercial use at the present time are based on a sulphonate-type anionic detergent, especially on alkyl benzene sulphonate, in conjunction with an alkyl polyethoxy sulphate (alkyl ether sulphate). The sulphonate-type detergent generally predominates.

The alkylbenzene sulphonates used in most developed countries are based on linear alkyl groups for maximum biodegradability. Linear alkylbenzene sulphonates are produced by sulphonation of linear alkyl benzenes, which in turn are manufactured by reacting appropriate olefins or chloroparaffins with benzene in the presence of an acid catalyst such as aluminium chloride or hydrogen fluoride. The olefins or chloroparaffins cover a range of chain lengths so that the reaction gives a mixture of alkylbenzenes of differing alkyl chain lengths. Furthermore, the reaction leads to a mixture of phenyl isomers in which the benzene ring is attached to different positions in the alkyl chains. Thus alkyl benzenes will vary considerably with respect both to alkyl chain length distribution and to phenyl isomer distribution depending on the starting feedstock and the catalyst used. Alkylbenzenes produced from chloroparaffins using an aluminium chloride catalyst contain relatively high proportions of 2-phenyl isomers, while those produced from olefins using a hydrogen fluoride catalyst contain relatively high proportions of central isomers.

Alkyl benzenes also differ from one another with respect to the content of impurities resulting from side reactions. The most important impurities are the hydrogen-deficient molecules, notably the dialkyl tetralins in which cyclisation of a part of the alkyl chain has occurred to form a six-membered ring fused with the benzene ring; dialkyl indanes, containing a five-membered fused ring, are also present to a lesser extent.

The alkyl ether sulphates commonly used in dishwashing liquids are materials of the general formula I:

$$R_1—O—(CH_2CH_2O)_n—SO_3X \quad (I)$$

wherein $R_1$ is a linear or branched alkyl group having form 10 to 18 carbon atoms, X is any solubilising cation, and n, the average degree of ethoxylation, is from 1 to 12, especially 1 to 8. In any particular commercially available alkyl ether sulphate a range of different chain lengths and differently ethoxylated materials will be present; the degree of ethoxylation n represents an average figure, and, for example, a material for which n is 3 will include individual materials ranging from n=0 (alkyl sulphate) to perhaps n=10.

The present invention is based on the observation that in light-duty liquid detergent compositions the use of combinations of certain selected alkylbenzene sulphonates with certain selected alkyl ether sulphates gives appreciably improved foaming performance in hard water. The improved results are obtained only if both components are optimised.

GB No. 1 068 528 (Colgate-Palmolive) discloses dishwashing detergent compositions based on alkylbenzene sulphonates and alkyl ether sulphates. The alkylbenzene sulphonate is derived from a linear alkylbenzene having a molecular weight of from 230 to 240 and containing at least 80 mole % of $C_{10}$, $C_{11}$ and $C_{12}$ material, of which at least half is $C_{10}$ and $C_{11}$ material, the $C_{10}$ and $C_{11}$ material constituting at least 45 mole % of the whole; the alkylbenzene also contains less than 2% of $C_9$ materials, less than 2% of $C_{14}$ material, less than 15% of $C_{13}$ material, and at least 60 mole % of central isomers, that is to say, isomers in which the benzene ring is attached to the 3- or higher position in the alkyl chain. The alkylbenzene sulphonate is used in conjunction with an alkyl ether sulphate containing 65% $C_{14}$ material and 35% $C_{12}$ material, to form a dishwashing detergent-composition.

GB No. 2 010 893 (Unilever) discloses a dishwashing detergent composition containing an alkylbenzene sulphonate (in magnesium salt form) derived from a linear alkylbenzene having an average molecular weight of from 220 to 250 and a dialkyl tetralin content of at least 3.5% by weight; the material exemplified has a molecular weight of 242 and a dialkyl tetralin content of 10%. The detergent composition disclosed also contains an alkyl ether sulphate, which may be a $C_{12}$–$C_{15}$alkyl 3EO sulphate or a lauryl 3EO sulphate.

GB No. 1 349 554 (Ethyl Corporation) discloses mixtures of $C_{10}$–$C_{20}$alkyl sulphates and alkyl ether sulphates in which 10 to 50% of the alkyl groups are $C_{10}$, and preferably 10 to 65% of the alkyl groups are $C_{10}$ and $C_{12}$. These mixtures may be used in conjunction with $C_{11}$–$C_{13}$alkylbenzene sulphonates, both high and low in 2-phenyl isomers, to prepare light-duty dishwashing detergent compositions.

The present invention provides a foaming liquid detergent composition in the form of a stable aqueous solution containing from 2 to 60% by weight of an active detergent mixture comprising (a) a linear $C_{10}$–$C_{13}$alkylbenzene sulphonate substantially free of material of other alkyl chain length and having a $C_{13}$ content not exceeding 15% by weight if its 2-phenyl isomer content is 30% by weight or more, or not exceeding 30% by weight if its 2-phenyl isomer content is less than 30% by weight, and (b) a $C_{10}$–$C_{18}$ primary alkyl ether sulphate containing 20% by weight or less of $C_{14}$ and above chain length material and having an average degree of ethoxylation of from 1 to 12, the weight ratio of (a) to (b) being within the range of from 8:1 to 0.5:1, and the composition being substantially free of alkylbenzene sulphonates and alkyl ether sulphates other than those defined under (a) and (b) above.

The weight ratio of (a) to (b) is preferably within the range of from 6:1 to 1:1, and more preferably within the range of from 2.5:1 to 1:1.

The concentration of the active detergent mixture in the composition of the invention is preferably from 5 to 40% by weight, and more preferably from 15 to 40% by weight.

The composition of the present invention may if desired contain other detergent-active materials within its active detergent mixture, provided that alkylbenzene sulphonates and alkyl ether sulphates other than those specified under (a) and (b) are substantially absent. Preferably at least 2%, more preferably at least 5% and most preferably at least 10%, of the whole composition is constituted by the alkylbenzene sulphonate (a); and preferably at least 1%, more preferably at least 2% and most preferably at least 5%, of the whole composition is constituted by the alkyl ether sulphate (b). Preferred additional ingredients are discussed in more detail below.

The linear $C_{10}$–$C_{13}$alkylbenzene sulphonate constituting component (a) is a narrow-cut material substantially free both of $C_9$ and shorter-chain material and of $C_{14}$ and longer-chain material. By "substantially free of" is meant a content of 5% by weight or less. The $C_{13}$ content is also relatively low: if the alkylbenzene sulphonate has a high 2-phenyl isomer content, of 30% by weight or more, the maximum $C_{13}$ content is 15% by weight. If the 2-phenyl isomer content is below 30% by weight, a somewhat higher proportion of $C_{13}$ material—up to 30% by weight—can be tolerated. Preferably, however, the $C_{13}$ content does not exceed 15% by weight regardless of the 2-phenyl isomer content.

Chain length distributions and phenyl isomer distributions of alkylbenzenes and alkylbenzene sulphonates may readily be determined by standard spectroscopic methods, notably mass spectrometry.

Table 1 shows the typical chain-length distributions and 2-phenyl isomer contents of some commercially available alkylbenzenes and/or alkylbenzene sulphonates. It will be apparent that Dob 102, Marlon A, Ucane 11, Dodane S and Nalkylene 500 are within the scope of the present invention, whereas Sirene X12L, Dob 055 and Korenyl Neu are outside.

(dialkyl tetralin content 2%, molecular weight 234–239) and Marlon A (dialkyl tetralin content less than 2%, molecular weight 238–241). Sirene X12L, which is outside the scope of the invention, is derived from an alkylbenzene having a dialkyl tetralin content of 12–17% and a molecular weight of 240–244.

The term "dialkyl tetralin" is used here to include dialkyl indanes and all other hydrogen-deficient materials present as impurities. As is well know to those skilled in the art, the level of hydrogen-deficient impurities in alkylbenzenes may readily be determined by NMR or mass spectrometry.

In the compositions of the invention, the alkylbenzene sulphonate may be used in the form of the salt of any suitable solubilising cation, that is to say, any cation yielding an alkylbenzene sulphonate salt sufficiently soluble to be detergent-active. The solubilising cation will generally be monovalent, for example, alkali metal, especially sodium; ammonium; or substituted ammonium, for example, ethanolamine. Certain divalent cations, notably magnesium, are also suitable. A mixture of salts of different cations may if desired be used.

The primary alkyl ether sulphate constituting component (b) is distinguished by a content of 20% by weight or less of material having a chain length of $C_{14}$ and above. The content of such long-chain material is preferably less than 10% by weight, and it is especially advantageous to use an ether sulphate substantially free of such material.

It is also preferred that the content of $C_{11}$ and shorter chain length material be as low as possible. Thus the ether sulphate used according to the present invention preferably consists predominantly of $C_{12}$ and $C_{13}$ material.

Table 2 shows the typical chain length distributions of some commercially available alkyl ether sulphates. Degrees of ethoxylation are omitted from the Table since most manufacturers provide a range of differently ethoxylated materials.

TABLE 1

| Material | Supplier | Chain lengths distribution $C_{10}$ | $C_{11}$ | $C_{12}$ | $C_{13}$ | $C_{14}$+ | 2-phenyl isomer content |
|---|---|---|---|---|---|---|---|
| Dob* 102 | Shell | 14 | 43 | 38 | 5 | — | 25 |
| Marlon* A | Huls | 4 | 44 | 40 | 11 | — | 20 |
| Ucane* 11 | Union Carbide | 11 | 38 | 40 | 8 | 1 | 30 |
| Dodane* S | Witco | 13 | 43 | 37 | 7 | 1 | 30 |
| Nalkylene* 500 | Conoco | 14 | 40 | 35 | 9 | 2 | 30 |
| Sirene* X12L | SIR | 7 | 30 | 34 | 25 | 3 | 38 |
| Dob* 055 | Shell | 8 | 17 | 17 | 20 | 38 | 21 |
| Korenyl* Neu | Texaxo/DEA | 8 | 36 | 35 | 20 | 1 | 37 |

*denotes Trademark

TABLE 2

| Trade Name | Manufacturer | Chain length distribution (weight %) $C_{10}$ & below | $C_{11}$ | $C_{12}$ | $C_{13}$ | $C_{14}$ | $C_{15}$ | $C_{16}$ & above |
|---|---|---|---|---|---|---|---|---|
| Dobanol* 25 | Shell | — | — | 25 | 25 | 25 | 25 | — |
| Dobanol* 23 | Shell | — | — | 50 | 50 | — | — | — |
| Empimin* 3003 3002 | Albright & Wilson | 2–4 | — | 63–71 | — | 22–28 | — | 8 (maximum) |
| Alfol* 12–14 | Conoco | — | — | 55 | — | 45 | — | — |

(* denotes Trademark)

Preferably the alkylbenzene sulphonate used in the compositions of the present invention is derived from an alkylbenzene having an average molecular weight within the range of from 234 to 245 and having a dialkyl tetralin content not exceeding 5% by weight. Examples of materials meeting this requirement include Dob 102

Preferred materials for use in the present invention are the Dobanol (Trade Mark) 23 series from Shell, which are virtually free of $C_{14}$ and higher chain length material.

Materials such as Dobanol (Trade Mark) 25 ex Shell and Alfol (Trade Mark) 12–14 ex Conoco are clearly outside the scope of the present invention.

The ether sulphates used according to the present invention containing 20% or less of $C_{14}$ and above chain length material ar preferably based on straight-chain or predominantly straight-chain alcohols. The Dobanol 23 series ex Shell, which are highly preferred for use according to the invention, consist of 75% straight-chain material and 25% 2-methyl-branched material.

The ether sulphates in Table 1 are all in fact based on wholly or predominantly straight-chain alcohols.

The ether sulphate used in the composition of the invention has an average degree of ethoxylation n of 1 to 12, preferably 1 to 8. This degree of ethoxylation gives optimum detergent properties in conjunction with the predominant chain lengths of $C_{12}$ and $C_{13}$.

If desired, the ether sulphate may be supplemented by the corresponding alkyl sulphate, that is to say, the corresponding material having an average degree of ethoxylation of zero.

The counter-cation of the alkyl ether sulphate may be any of the solubilising cations mentioned previously in connexion with the alkylbenzene sulphonate. Mixtures of salts of different cations may if desired be used.

As previously mentioned, additional detergent-active materials may be present in the compositions of the invention. The alkylbenzene sulphonate constituting component (a) may, for example, be supplemented or partially replaced by other sulphonate-type detergents, for example, secondary alkane sulphonates, alpha-olefin sulphonates, alkyl glyceryl ether sulphonates, fatty acid ester sulphonates, or dialkyl sulphosuccinates. Our copending application of even date, claiming the priority of our British Patent Application No. 82 32643 filed on 16 November 1982, describes and claims liquid detergent compositions containing mixtures of alkyl benzene sulphonates, dialkyl sulphosuccinates and alkyl ether sulphates. There may also be present primary or secondary alkyl sulphates.

Alternatively or additionally, the alkyl ether sulphate constituting component (b) may be supplemented or partially replaced by an ethoxylated nonionic detergent having an alkyl chain length of from $C_8$ to $C_{15}$ and an average degree of ethoxylation of from 5 to 14, for example, a short-chain high-foaming ethoxylated alcohol of the general formula II:

$$R_2—O—(CH_2CH_2O)_m—H \qquad (II)$$

wherein $R_2$ is an alkyl group, preferably straight-chain, having from 8 to 12 carbon atoms, and the average degree of ethoxylation m is from 5 to 12.

The weight ratio of alkyl ether sulphate to nonionic detergent is preferably at least 1:1 and more preferably within the range of from 1.5:1 to 3:1, especially about 2:1. An especially preferred nonionic detergent is Dobanol (Trade Mark) 91-8 ex Shell, in which $R_4$ is $C_9$–$C_{11}$ (predominantly straight-chain) and m is 8.

Other detergent-active materials of lesser interest that may nevertheless be included in minor amounts in the compositions of the invention include propoxylated nonionic detergents, ethoxylated and propoxylated fatty acid amides, amine oxides, betaines and sulphobetaines, and fatty acid mono- and dialkanolamides.

The compositions of the invention will generally also contain minor amounts of one or more hydrotropes.

Hydrotropes are materials present in a formulation to control solubility, viscosity, clarity and stability, but which themselves make no active contribution to the performance of the product. Examples of hydrotropes include lower aliphatic alcohols, especially ethanol; urea; lower alkylbenzene sulphonates such as sodium toluene and xylene sulphonates; and combinations of these.

As well as active detergent, water and (if necessary) hydrotrope, the compositions may contain the usual minor ingredients such as perfume, colour, preservatives and germicides.

The liquid detergent compositions of the invention, containing 2 to 60% by weight of active detergent in stable aqueous solution, may be used for all normal detergent purposes where foaming is advantageous, for example, fabric washing products, general purpose domestic and industrial cleaning compositions, carpet shampoos, car wash products, personal washing products, shampoos, foam bath products, and, above all, manual dishwashing.

The invention is further illustrated by the following non-limiting Examples.

EXAMPLES

In the Examples the hard water foaming performances of various formulations were compared using a plate washing test. In the test, plates soiled with a standard starch/fat/fatty acid mixture were washed in a standard manner with 5 liters of test solution (total concentration of the product 1 g/liter in 24° H (French hardness) water at 45° C.) in a bowl, until only a third of the surface of the solution in the bowl was covered with foam. The number of plates washed before this arbitrary end-point was reached was taken as an indicator of dishwashing and foaming performance.

The alkylbenzene sulphonates used to exemplify compositions of the invention are Dob 102, Marlon A and Ucane 11, detals of which are given previously; the comparative material outside the invention used was Sirene X12L. All were used in the form of their sodium salts. The ether sulphates used according to the invention were Dobanol 23-3A (n=3, ammonium salt) and Dobanol 23-2A (n=2, ammonium salt), and the comparative material outside the invention used was Dobanol 25-3A (n=3, ammonium salt).

EXAMPLES 1 TO 3

In this experiment, the performances of three alkylbenzene sulphonate/alkyl ether sulphate combinations according to the invention (Compositions 1 to 3) were compared with three combinations outside the invention (Compositions A, B and C). In each case the weight ratio of alkylbenzene sulphonate to alkyl ether sulphate was 27:13 and the total concentration of detergent-active material in the products was 40% by weight. The results are shown in the following Table, from which it may be seen that the compositions of the invention washed 7 to 12 more plates than Comparative Compositions A and B, in which one of the two components was non-optimum, and 12 to 15 more plates than Comparative Composition C, in which both components were non-optimum.

| | Composition | | | | | |
|---|---|---|---|---|---|---|
| Component (wt %) | 1 | 2 | 3 | A | B | C |
| (a) Dob 102 | 27 | 27 | — | 27 | — | — |
| " Marlon A | — | — | 27 | — | — | — |

-continued

| Component (wt %) | Composition 1 | 2 | 3 | A | B | C |
|---|---|---|---|---|---|---|
| " Sirene X12L | — | — | — | — | 27 | 27 |
| (b) Dobanol 23-3A | 13 | — | 13 | — | 13 | — |
| " Dobanol 23-2A | — | 13 | — | — | — | — |
| " Dobanol 25-3A | — | — | — | 13 | — | 13 |
| Plates washed | 34 | 34 | 37 | 27 | 25 | 22 |

EXAMPLES 4 AND 5

A similar procedure to that of Examples 1 to 3 was carried out using a 1:1 ratio of alkylbenzene sulphonate to alkyl ether sulphate (20% by weight of each in the product). As may be seen from the following Table, similar results were obtained.

| Component (wt %) | Composition 4 | 5 | D | E | F |
|---|---|---|---|---|---|
| (a) Dob 102 | 20 | — | 20 | — | — |
| " Marlon A | — | 20 | — | — | — |
| " Sirene X12L | — | — | — | 20 | 20 |
| (b) Dobanol 23-3A | 20 | 20 | — | 20 | — |
| " Dobanol 25-3A | — | — | 20 | — | 20 |
| Plates washed | 34 | 35 | 27 | 28 | 24 |

EXAMPLE 6

A composition was prepared from the alkylbenzene sulphonate Ucane 11 (23%) and the alkyl ether sulphate Dobanol 23-3A (12%). This composition washed 32 plates in 24° H water. The corresponding composition containing the alkyl ether sulphate Dobanol 25-3A washed ony 24 plates in 24° H water.

We claim:

1. A foaming liquid detergent composition in the form of a stable aqueous solution containing from 2 to 60% by weight of an active detergent mixture comprising (a) a linear $C_{10}$–$C_{13}$alkylbenzene sulphonate substantially free of material of other alkyl chain length and having a $C_{13}$ content not exceeding 15% by weight if its 2-phenyl isomer content is 30% by weight or more, or not exceeding 30% by weight if its 2-phenyl isomer content is less than 30% by weight, and (b) a $C_{10}$–$C_{18}$ primary alkyl ether sulphate containing 20% by weight or less of $C_{14}$ and above chain length material and having an average degree of ethoxylation of from 1 to 12, the weight ratio of (a) to (b) being within the range of from 8:1 to 0.5:1, and the composition being substantially free from alkylbenzene sulphonates and alkyl ether sulphates other than those defined under (a) and (b) above.

2. The detergent composition of claim 1, wherein component (a) is a linear $C_{10}$–$C_{13}$alkylbenzene sulphonate substantially free of material of other alkyl chain lengths and having a $C_{13}$ content not exceeding 15% by weight.

3. The detergent composition of claim 1, wherein the linear alkylbenzene sulphonate (a) is derived from a linear $C_{10}$–$C_{13}$alkylbenzene having an average molecular weight of from 234 to 245 and a dialkyl tetralin content not exceeding 5% by weight.

4. The detergent composition of claim 1, wherein the alkyl ether sulphate (b) contains 10% by weight or less of material of $C_{14}$ and above chain length.

5. The detergent composition of claim 4, wherein the alkyl ether sulphate (b) is substantially free of material of $C_{14}$ and above chain length.

6. The detergent composition of claim 1, wherein the alkyl ether sulphate (b) has an average degree of ethoxylation of from 1 to 8.

7. The detergent composition of claim 6, wherein the alkyl ether sulphate (b) has an average degree of ethoxylation of 2 or 3.

8. The detergent composition of claim 1, wherein the alkyl ether sulphate (b) is derived from straight-chain or predominantly straight chain aliphatic alcohols.

9. The detergent composition of claim 1, which contains from 5 to 40% of the active detergent mixture.

10. The detergent composition of claim 9, which contains from 15 to 40% of the active detergent mixture.

11. The detergent composition of claim 1, wherein the weight ratio of (a) to (b) is within the range of from 6:1 to 1:1.

12. The detergent composition of claim 11, wherein the weight ratio of (a) to (b) is within the range of from 2.5:1 to 1:1.

13. The detergent composition of claim 1, which contains at least 10% by weight of component (a).

14. The detergent composition of claim 1, which contains at least 5% by weight of component (b).

* * * * *

REEXAMINATION CERTIFICATE (1132nd)

United States Patent [19]

[11] B1 4,537,709

Edge et al.

[45] Certificate Issued Sep. 26, 1989

[54] LIQUID DETERGENT COMPOSITION COMPRISING SELECTED ALKYLBENZENE SULPHONATES AND ALKYL ETHER SULPHATES

[75] Inventors: David J. Edge, Chester; Appaya R. Naik, Merseyside; Melvin Scott, Cheshire, all of England

[73] Assignee: Lever Brothers Company, New York, N.Y.

Reexamination Request:
No. 90/001,199, Mar. 25, 1987

Reexamination Certificate for:

| | |
|---|---|
| Patent No.: | **4,537,709** |
| Issued: | **Aug. 27, 1985** |
| Appl. No.: | **551,456** |
| Filed: | **Nov. 14, 1983** |

[30] Foreign Application Priority Data

Nov. 16, 1982 [GB] United Kingdom ..... 8232644

[51] Int. Cl.[4] ..... C11D 1/12; C11D 1/29; C11D 1/37; C11D 3/065

[52] U.S. Cl. ..... 252/558; 252/534; 252/553

[58] Field of Search ..... 252/558, 534, 553

[56] References Cited

U.S. PATENT DOCUMENTS 4,554,098 11/1985 Klisch et al. ..... 252/547

FOREIGN PATENT DOCUMENTS 49-13205 of 1974 Japan .
53-21206 of 1978 Japan .
8100106 1/1981 PCT Int'l Appl. .
2114996 2/1983 United Kingdom .

*Primary Examiner*—Paul R. Michl

[57] ABSTRACT

In light-duty liquid detergent compositions suitable for hand dishwashing, improved foaming performance, especially in hard water, is obtained by using combinations of particular alkylbenzene sulphonates (linear $C_{10}$–$C_{13}$ alkylbenzene sulphonates substantially free of other alkyl chain lengths and containing only minor amounts of $C_{13}$ material) and particular alkyl ether sulphates (those containing 20% or less of $C_{14}$ and above material and having an average degree of ethoxylation of from 1 to 12).

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT.

Claims 3, 4, 5 and 11 are cancelled.

Claims 1 and 2 are determined to be patentable as amended.

Claims 6–10 and 12–14, dependent on an amended claim, are determined to be patentable.

New claims 15 and 16 are added and determined to be patentable.

1. A foaming liquid detergent composition in the form of a stable aqueous solution containing from 2 to 60% by weight of an active detergent mixture comprising (a) a *mixture of* linear $C_{10}-C_{13}$ alkylbenzene sulphonate substantially free of material of other alkyl chain length and having a $C_{13}$ content not exceeding 15% by weight if its 2-phenyl isomer content is 30% by weight or more, or not exceeding 30% by weight if its 2-phenyl isomer content is less than 30% by weight, and *derived from a linear* $C_{10-10}$ *alkylbenzene having an average molecular weight of from 234 to 241, and*

(b) a [$C_{10}$–$C_{18}$] primary alkyl ether sulphate containing [20% by weight or less of $C_{14}$ and above] *consisting of material of chain length* $C_{12}$ *and material of* chain length [material] $C_{13}$ and having an average degree of ethoxylation of from 1 to 12, the weight ratio of (a) to (b) being within the range of from [8:1 to 0.5:1] *6:1 to 1:1*, and the composition being substantially free from alkylbenzene sulphonates and alkyl ether sulphates other than those defined under (a) and (b) above.

2. The detergent composition of claim 1, wherein component (a) [is a linear $C_{10}$–$C_{13}$ -alkylbenzene sulphonate substantially free of material of other alkyl chain lengths and having] *has* a $C_{13}$ content not exceeding 15% by weight.

*15. A foaming liquid detergent composition in the form of a stable aqueous solution containing from 2 to 60% by weight of an active detergent mixture comprising*

*(a) a mixture of linear $C_{10}$–$C_{13}$ alkylbenzene sulphonate substantially free of material of other alkyl chain length and having a $C_{13}$ content not exceeding 15% by weight if its 2-phenyl isomer content is 30% by weight or more, or not exceeding 30% by weight if its 2-phenyl isomer content is less than 30% by weight, and derived from a linear $C_{10}$–$C_{13}$ alkylbenzene having an average molecular weight of from 234 to 241, and*

*(b) a primary alkyl ether sulphate consisting of material of chain length $C_{12}$ and material of chain length $C_{13}$ and having an average degree of ethoxylation of about 3,*

*the weight ratio of (a) to (b) being within the range of from 2.5:1 to 1:1, and the composition being substantially free of alkylbenzene sulphonates and alkyl ether sulphates other than those defined under (a) and (b) above.*

*16. A foaming liquid detergent composition in the form of a stable aqueous solution containing from 2 to 60% by weight of an active detergent mixture comprising*

*(a) a mixture of linear $C_{10}$–$C_{13}$ alkylbenzene sulphonate substantially free of material of other alkyl chain length and having a $C_{13}$ content not exceeding 15% by weight if its 2-phenyl isomer content is 30% by weight or more, or not exceeding 30% by weight if its 2-phenyl isomer content is less than 30% by weight, and derived from a linear $C_{10}$–$C_{13}$ alkylbenzene having an average molecular weight of from 234 to 239, and*

*(b) a primary alkyl ether sulphate consisting of material of chain length $C_{12}$ and material of chain length $C_{13}$ and having an average degree of ethoxylation of about 3, the weight ratio of (a) to (b) being within the range of from 2:1 to 1:1, and the composition being substantially free of alkylbenzene sulphonates and alkyl ether sulphates other than those defined under (a) and (b) above.*

* * * * *